US010557351B2

(12) United States Patent
Amano

(10) Patent No.: US 10,557,351 B2
(45) Date of Patent: Feb. 11, 2020

(54) CENTER VENT TUBE ALIGNING MECHANISM AND CENTER VENT TUBE SUPPORT DEVICE

(71) Applicant: IHI Corporation, Koto-ku (JP)

(72) Inventor: Shinichi Amano, Tokyo (JP)

(73) Assignee: IHI Corporation, Koto-ku (JP)

( * ) Notice: Subject to any disclaimer, the term of this patent is extended or adjusted under 35 U.S.C. 154(b) by 346 days.

(21) Appl. No.: 15/490,391

(22) Filed: Apr. 18, 2017

(65) Prior Publication Data

US 2017/0218766 A1 Aug. 3, 2017

Related U.S. Application Data

(63) Continuation of application No. PCT/JP2015/081957, filed on Nov. 13, 2015.

(30) Foreign Application Priority Data

Jan. 26, 2015 (JP) ..... 2015-012153

(51) Int. Cl.
*F01D 5/02* (2006.01)
*F01D 25/16* (2006.01)
(Continued)

(52) U.S. Cl.
CPC ..... *F01D 5/02* (2013.01); *F01D 25/00* (2013.01); *F01D 25/16* (2013.01); *F01D 25/18* (2013.01); *F01D 25/28* (2013.01); *F05D 2230/642* (2013.01); *F05D 2230/644* (2013.01); *F05D 2240/61* (2013.01); *F05D 2260/605* (2013.01)

(58) Field of Classification Search
CPC . B23P 11/00; B23P 17/00; B23P 19/00; F16C 1/00; F16C 1/26; H02G 3/065; H02G 3/04; H02G 3/06; H02G 3/02
See application file for complete search history.

(56) References Cited

U.S. PATENT DOCUMENTS 3,038,556 A 6/1962 Hamm et al.
3,285,551 A * 11/1966 Tschanz ..... F16C 1/103 248/56
(Continued)

FOREIGN PATENT DOCUMENTS

FR 3 008 135 A1 1/2015
FR 3 058 480 A1 5/2018
(Continued)

*Primary Examiner* — Lee D Wilson
(74) *Attorney, Agent, or Firm* — Oblon, McClelland, Maier & Neustadt, L.L.P.

(57) ABSTRACT

A center vent tube aligning mechanism which aligns a center vent tube inserted into a hollow shaft is provided with: an annular portion which is coaxially provided with the center vent tube in an outer side of the center vent tube in a radial direction thereof; a flexible portion which protrudes in a direction along an axis of the center vent tube from the annular portion; an abutting portion which is connected to the flexible portion and which abuts an inner circumferential surface of the shaft; and a cylindrical sleeve which surrounds the center vent tube from the outer side in a radial direction of the center vent tube and which is supported by a reaction force that the abutting portion receives from the inner circumferential surface of the shaft.

8 Claims, 10 Drawing Sheets

(51) Int. Cl.

| | |
|---|---|
| ***F01D 25/18*** | (2006.01) |
| ***F01D 25/28*** | (2006.01) |
| ***F01D 25/00*** | (2006.01) |

(56) References Cited

U.S. PATENT DOCUMENTS

| | | | | |
|---|---|---|---|---|
| 4,548,546 | A | 10/1985 | Lardellier | |
| 6,167,605 | B1 * | 1/2001 | Morales | A61F 2/958 29/282 |
| 6,360,418 | B1 | 3/2002 | Freeman et al. | |
| 6,993,816 | B2 * | 2/2006 | Greenhill | B25B 27/0028 29/229 |
| 8,720,302 | B2 * | 5/2014 | Foster | F16C 1/105 74/502.4 |
| 9,863,278 | B2 | 1/2018 | Sultana et al. | |
| 2004/0025494 | A1 | 2/2004 | Vache et al. | |
| 2006/0158053 | A1 | 7/2006 | Aschoff et al. | |
| 2009/0282679 | A1 * | 11/2009 | Mons | F01D 5/085 29/889.2 |
| 2013/0045078 | A1 | 2/2013 | Boldt | |
| 2015/0300206 | A1 | 10/2015 | Sultana et al. | |
| 2016/0082578 | A1 * | 3/2016 | Stepp | B25B 27/023 29/259 |
| 2017/0191416 | A1 | 7/2017 | Amano et al. | |
| 2018/0128180 | A1 | 5/2018 | Durand et al. | |

FOREIGN PATENT DOCUMENTS

| | | |
|---|---|---|
| JP | 58-88403 | 5/1983 |
| JP | 2004-514841 | 5/2004 |
| JP | 2006-519581 | 8/2006 |
| JP | 2009-174528 | 8/2009 |
| JP | 5336864 | 11/2013 |
| JP | 2015-535048 A | 12/2015 |
| WO | WO 2014/072626 A2 | 5/2014 |
| WO | WO 2015/004357 A1 | 1/2015 |
| WO | WO 2016/075984 A1 | 5/2016 |

* cited by examiner

CENTER VENT TUBE ALIGNING MECHANISM AND CENTER VENT TUBE SUPPORT DEVICE

This application is a Continuation Application based on International Application No. PCT/JP2015/081957, filed on Nov. 13, 2015, which claims priority on Japanese Patent Application No. 2015-012153, filed on Jan. 26, 2015, the contents of which are incorporated herein by reference.

TECHNICAL FIELD

The present disclosure relates to a center vent tube aligning mechanism and a center vent tube support device.

BACKGROUND ART

A jet engine includes a shaft functioning as a principal axis that transmits rotating power generated by a turbine to a compressor or the like. In the jet engine, these may be a case where the shaft is made to be hollow and a center vent tube is provided inside the shaft. In the center vent tube, a distal end portion of the center vent tube is fixed to the shaft, and the center vent tube is rotated with the shaft and discharges a lubricant used at a bearing or the like from a lubricant closure to the outside.

The thermal deformation amount of the center vent tube and the thermal deformation amount of the shaft are different from each other due to a difference in materials and shapes thereof. Therefore, if the center vent tube is rigidly fixed to the shaft at multiple locations in an axial direction of the shaft, large stress is locally generated at the multiple fixed locations due to thermal deformation. Furthermore, the center vent tube is twisted when the center tube is rotated along with the shaft. In this case as well, large stress is locally generated at the multiple fixed locations. Accordingly, in general only the distal end of the center vent tube is rigidly fixed to the shaft and the number of fixed locations between the center vent tube and the shaft is reduced as much as possible. However, since the center vent tube is an elongated member, positional regulation of the center cent tube inside the shaft cannot be performed in a case where on only the distal end of the center vent tube is fixed. Accordingly, an aligning device, which aligns the center vent tube by slidably supporting the center vent tube with respect to one location or multiple locations in the axial direction of the shaft, is provided (refer to Patent Document 1).

The aligning device includes a cylindrical sleeve (a ring 50 in Patent Document 1) which surrounds the center vent tube and a support ring (a ring 62 in Patent Document 2) which is inserted between the sleeve and the shaft and which supports the sleeve. The aligning device slidably supports the center vent tube by making a resin ring, which is disposed between an inner circumferential surface of the sleeve and an outer circumferential surface of the center vent tube, about the center vent tube.

As shown in Patent Document 1, a portion of an outer circumferential surface of the sleeve is made to be a tapered surface. The support ring is pushed out and enlarged from inside in a radial direction thereof to outside in the radial direction thereof by the tapered surface of the sleeve. With the support ring being pushed out and enlarged, a reaction force the support ring receives from an inner circumferential surface of the shaft becomes a force (retention force) which retains the sleeve. Accordingly, the sleeve is supported.

Patent Document 2, Patent Document 3, Patent Document 4, and Patent Document 5 disclose related techniques.

CITATION LIST

Patent Document

[Patent Document 1] Japanese Unexamined Patent Application, First Publication No. 2009-174528

[Patent Document 2] Published Japanese Translation No. 2004-514841 of the PCT International Publication

[Patent Document 3] Published Japanese Translation No. 2006-519581 of the PCT International Publication

[Patent Document 4] Japanese Unexamined Patent Application, First Publication No. S58-88403

[Patent Document 5] Japanese Patent No. 5336864

SUMMARY

Technical Problem

Unless a retention force which retains the sleeve is balanced in a circumferential direction of the sleeve, deformation of the sleeve may occur or the axial position of the sleeve may change, and may be a cause for local abrasion or the like of the center vent tube. A conventional support ring is C-shaped and a portion thereof in a circumferential direction is cut out as shown in FIG. 10 so that the conventional support ring can be easily pushed out and enlarged when the conventional support ring is made to abut the inner circumferential surface of the shaft. In a conventional support ring, the cut out portion 100 may be enlarged and deformed around a support ring center O which is interposed between the cut out portion 100 and a segment of the conventional support ring on the opposite side thereof from the cut out portion 100. Accordingly, when the support ring is pushed out and enlarged, the support ring may not be enlarged radially from a center of the sleeve and the deformation amount of the support ring may not be equal in the circumferential direction of the support ring. Therefore, in a location where the deformation amount of the support ring in the circumferential direction thereof is maximized, the retention force with which the support ring retains the sleeve becomes large locally, and balance of the retention force in the circumferential direction of the support ring may collapse.

The present disclosure is made in consideration of the above-described circumstances, and an object thereof is to prevent deformation or dislocation of the sleeve by keeping a balance of the retention force of the sleeve in the circumferential direction of the sleeve in a mechanism which aligns the center vent tube.

Solution to Problem

A first aspect of the present disclosure is a center vent tube aligning mechanism which aligns a center vent tube inserted into a hollow shaft. The center vent tube aligning mechanism includes; an annular portion which is coaxially provided with the center vent tube in an outer side of the center vent tube in a radial direction thereof; a flexible portion which protrudes in a direction along an axis of the center vent tube from the annular portion; an abutting portion which is connected to the flexible portion and which abuts an inner circumferential surface of the shaft; and a cylindrical sleeve which surrounds the center vent tube from the outer side in the radial direction of the center vent tube and which is supported by a reaction force that the abutting portion receives from the inner circumferential surface of the shaft.

In a second aspect of the present disclosure, a plurality of the flexible portions and a plurality of the abutting portions are discretely provided along a circumferential direction of the sleeve.

A third aspect of the present disclosure further includes an integrated member which integrates together the sleeve with a thread groove on an outer circumferential surface thereof, the annular portion, the flexible portion, and the abutting portion provided such that a gap is provided between the sleeve and the abutting portion, and a nut which is screwed onto the thread groove and located between the sleeve and the abutting portion and has a tapered surface which is provided on an outer circumferential surface thereof and which abuts the abutting portion.

A fourth aspect of the present disclosure further includes an integrated member which integrates together a nut which is screwed onto the thread groove, the annular portion, the flexible portion, and the abutting portion which abuts the tapered surface of the sleeve, in which the sleeve is provided with a thread groove and a tapered surface on an outer circumferential surface of the sleeve.

A fifth aspect of the present disclosure further includes an integrated member which integrates together the annular portion, the flexible portion, and the abutting portion which abuts the tapered surface of the sleeve, and a nut which screws onto the thread groove and fastens together the integrated member and the sleeve, in which the sleeve is provided with a thread groove and a tapered surface on an outer circumferential surface of the sleeve.

In a sixth aspect of the present disclosure, the integrated member is set such that a maximum dimension thereof in a direction along the horizontal axis which passes a center of the sleeve and is along a radial direction of the sleeve is smaller than a maximum dimension thereof in a direction along the vertical axis which is orthogonal to the horizontal axis.

A seventh aspect of the present disclosure is a center vent tube support device which uses the center vent tube aligning mechanism.

According to the present disclosure, the abutting portion which abuts the inner circumferential surface of the shaft is provided, the reaction force that the abutting portion receives from the inner circumferential surface of the shaft is transmitted to the sleeve as the retention force, and the sleeve is retained by the retention force. The abutting portion is connected to the annular portion, which is coaxially provided with the center vent tube, via the flexible portion which protrudes in the direction along the axis of the center vent tube. In the abutting portion, when the abutting portion is pushed from an inner side in the radial direction of the center vent tube to the outer side in the radial direction of the center vent tube, the abutting portion moves along the radial direction of the center vent tube with the flexible portion being deformed. Accordingly, when the abutting portion is pushed to the outer side in the radial direction in order to generate the retention force of the sleeve, the abutting portion is always pushed from a direction orthogonal to the inner circumferential surface of the shaft. Therefore, the abutting portion is equally pushed from the inner circumferential surface of the shaft. As a result, the reaction force that the abutting portion receives from the inner circumferential surface of the shaft (the retention force of the sleeve) is equalized in the circumferential direction of the sleeve. According to the present disclosure, since it is possible to present the balance of the retention force of the sleeve from collapsing by biasing the retention force of the sleeve, it is possible to prevent the sleeve from being deformed and dislocated.

BRIEF DESCRIPTION OF DRAWINGS

FIG. 4 is a perspective view of a sleeve unit portion that the center vent tube aligning mechanism in accordance with the first embodiment of the present disclosure is provided with.

FIG. 5 is a front view of the sleeve unit portion that the center vent tube aligning mechanism in accordance with the first embodiment of the present disclosure is provided with.

DESCRIPTION OF EMBODIMENTS

Hereinafter, an embodiment of a center vent tube aligning MECHANISM according to the present disclosure will be described with reference to the drawings. In addition, in the following drawings, the scale of each member is appropriately changed such that each member can be recognized.

(First Embodiment)

Figure 1:
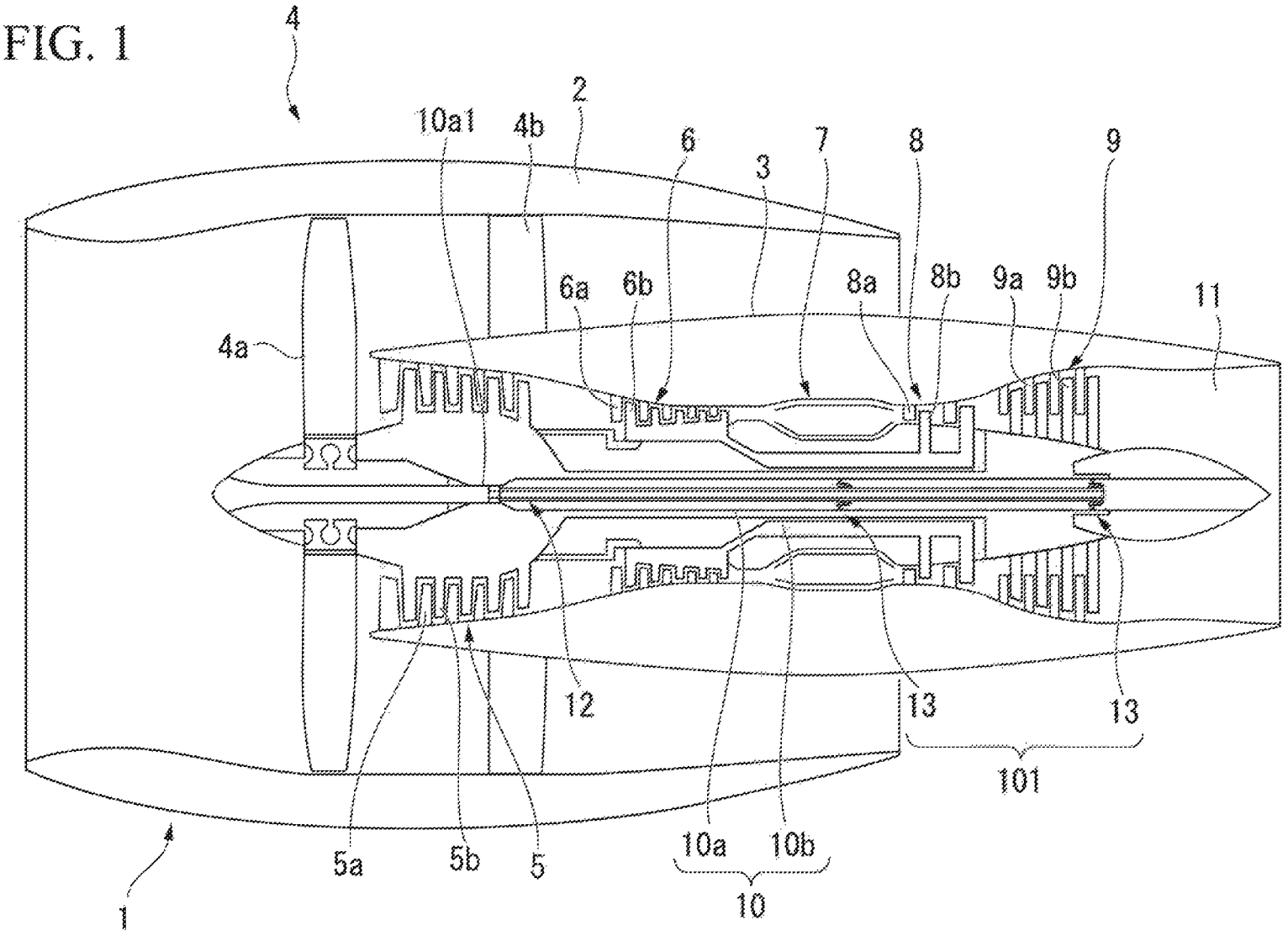
FIG. 1 is a sectional view showing a schematic configuration of a jet engine provided with a center vent tube aligning mechanism in accordance with a first embodiment of the present disclosure.

First, a jet engine that the center vent tube aligning mechanism of the present embodiment is mounted will be described with reference to FIG. 1. In the following description, the direction the air flows is regarded as a reference and the left side of FIG. 1 is referred to as an upstream and right side of FIG. 1 is referred to as a downstream. FIG. 1 is a sectional view showing a schematic configuration of a jet engine 1. As shown in FIG. 1, the jet engine 1 includes a fan cowl 2, a core cowl 3, a fan unit 4, a low-pressure compressor 5, a high-pressure compressor 6, a combustor 7, a high-pressure turbine 8, a low-pressure turbine 9, a shaft 10, a main nozzle 11, a center vent tube 12, and a center vent tube aligning mechanism 13.

The fan cowl 2 is an approximately cylindrical member whose upstream end portion and downstream end portion are open, and the fan unit 4 or the like are accommodated in the fan cowl 2. The fan cowl 2 covers the upstream side of the core cowl 3 which is coaxially disposed with the fan cowl 2, and the fan cowl 2 is supported by the core cowl 3 by a support portion which is not shown. The fan cowl 2 takes external air from an opening on the upstream side to the inside of the fan cowl 2, and guides the taken external air to the downstream toward the core cowl 3. The core cowl 3 is an approximately cylindrical member which has a smaller diameter than that of the fan cowl 2, and the upstream end portion and the downstream end portion of the core cowl 3 are open. The low-pressure compressor 5, the high-pressure compressor 6, the combustor 7, the high-pressure turbine 8, the low-pressure turbine 9, the shaft 10, and the like are accommodated in the core cowl 3. The fan cowl 2 and the core cowl 3 are attached to an airframe of an aircraft by a pylon (not shown). Here, the approximately cylindrical member may not be only members whose cross-section is circular but also members whose cross-section is elliptical or polygonal.

The inside of the core cowl 3 is a channel (hereinafter, referred to as a core channel) in which the upstream of the combustor 7 is a channel for air to be supplied to the combustor 7 and the downstream of the combustor 7 is a channel for combustion gas generated in the combustor 7. The gap between the fan cowl 2 and the core cowl 3 is a bypass channel which discharges remaining air which is taken into the fan cowl 2 but not taken into the core channel to the outside.

The fan 4 unit includes a rotor blade row 4*a* provided with a plurality of fan rotor blades fixed to the shaft 10, and a stator blade row 4*b* provided with fan stator blades disposed in the bypass channel. The rotor blade row 4*a* force-feeds air to the downstream with the rotation of the shaft 10. The stator blade row 4*b* straightens air flow in the bypass channel. As described later, the shaft 10 is constituted by a first shaft 10*a* provided at an inner side of the shaft 10 in a radial direction thereof and a second shaft 10*b* provided at an outer side of the first shaft 10*a* in the radial direction thereof so as to surround the first shaft 10*a*. The fan rotor blades that configure the rotor blade row 4*a* are fixed to the first shaft 10*a* of the shaft 10.

The low-pressure compressor 5 is disposed on the upstream of the high-pressure compressor 6, and includes a plurality of stator blade rows 5*a* and rotor blade rows 5*b* which are disposed one after the other along a flow direction of the core channel. The stator blade rows 5*a* are formed by a plurality of stator blades which are fixed onto an inner wall of the core cowl 3 and which are annularly disposed centered on the shaft 10. The rotor blade rows 5*b* are formed by a plurality of rotor blades which are fixed to the first shaft 10*a* of the shaft 10 and which are annularly disposed centered on the shaft 10. The low-pressure compressor 5 compresses air which is fed to the core channel with the rotor blade rows 5*b* being rotated by the first shaft 10*a*.

The high-pressure compressor 6 is disposed on the downstream of the low-pressure compressor 5, and has approximately the same constitution as the low-pressure compressor 5. That is, the high-pressure compressor 6 includes a plurality of stator blade rows 6*a* and rotor blade rows 6*b* which are disposed one after the other along the flow direction of the core channel. The stator blade rows 6*a* are formed by a plurality of stator blades which are fixed onto the inner wall of the core cowl 3 and which are annularly disposed centered on the shaft 10. The rotor blade rows 6*b* are formed by a plurality of rotor blades which are fixed to the second shaft 10*b* of the shaft 10 and which are annularly disposed centered on the shaft 10. The high-pressure compressor 6 further compresses air which is compressed by the low-pressure compressor 5 with the rotor blade rows 6*b* being rotated by the second shaft 10*b*.

The combustor 7 is disposed on the downstream of the high-pressure compressor 6 and combusts a mixture of the compressed air fed from the high-pressure compressor 6 and a fuel supplied from an injector (not shown) to generate the combustion gas. For example, in the combustor 7, the flow rate of the fuel supplied from the injector is controlled electronically. Accordingly, the amount of the combustion gas generated (thrust of the jet engine 1) is adjusted.

The high-pressure turbine 8 is disposed on the downstream of the combustor 7, and includes a plurality of stator blade rows 8*a* and rotor blade rows 8*b* which are disposed one after the other along the flow direction of the core channel. The stator blade rows are formed by a plurality of stator blades which are fixed onto the inner wall of the core cowl 3 and which are annularly disposed centered on the shaft 10. The rotor blade rows 8*b* are formed by a plurality of rotor blades which are fixed to the second shaft 10*b* of the shaft 10 and which are annularly disposed centered on the shaft 10. The high-pressure turbine 8 rotates the second shaft 10*b* with the stator blade rows 8*a* straightening the combustion gas and the rotor blade rows 8*b* receiving the combustion gas.

The low-pressure turbine 9 is disposed on the downstream of the high-pressure turbine 8, and has approximately the same configuration as the high-pressure turbine 8. That is, the low-pressure turbine 9 includes a plurality of stator blade rows 9*a* and rotor blade rows 9*b* which are disposed one after the other along the flow direction of the core channel. The stator blade rows 9*a* are formed by a plurality of stator blades which are fixed onto the inner wall of the core cowl 3 and which are annularly disposed centered on the shaft 10. The rotor blade rows 9*b* are formed by a plurality of rotor blades which are fixed to the first shaft 10*a* of the shaft 10 and which are annularly disposed centered on the shaft 10. The low-pressure turbine 9 rotates the first shaft 10*a* with the stator blade rows 9*a* straightening the combustion gas and the rotor blade rows 9*b* receiving the combustion gas.

The shaft 10 is configured by the first shaft 10*a* provided at the inner side of the shaft 10 in the radial direction thereof and the second shaft 10*b* provided at an outer side of the shaft 10 in the radial direction thereof. The first shaft 10*a* has such a length that the first shaft 10*a* is elongated from the rotor blade rows 4*a* of the fan unit 4 to the rotor blade rows 9*b* of the low-pressure turbine 9. The rotor blade rows 4*a* of the fan unit 4 and the rotor blade rows 5*b* of the low-pressure compressor 5 are provided in the upstream side of the first shall 10*a* and the rotor blade rows 9*b* of the low-pressure turbine 9 are provided in the downstream side of the first shaft 10*a*. The first shaft 10*a* is cylindrical in which upstream end portion and downstream end portion thereof are open, and the center vent rube 12 is accommodated inside the first shaft 10*a*. As shown in FIG. 1, the first shaft 10*a* includes a narrow portion 10*a*1. The narrow portion 10*a*1 is a segment which protrudes in the inner side in the radial direction of the first shaft 10*a* and makes the opening area inside smaller. A distal end portion of the center vent tube 12 is fixed to the narrow portion 10*a*1. The first shaft 10*a* is rotated by the rotor blade rows 9*b* of the low-pressure turbine 9 and transmits a rotating power of the low-pressure turbine 9 to the rotor blade rows 4*a* of the fan unit 4 and the rotating blade rows 5*b* of the low-pressure compressor 5.

The second shaft 10*b* has such a length that the second shaft 10*b* is elongated from the rotor blade rows 6*b* of the high-pressure compressor 6 to the rotor blade rows 8*b* of the high-pressure turbine 8. The rotor blade rows 6*b* of the high-pressure compressor 6 are provided in the upstream side of the second shaft 10*b* and the rotor blade rows 8*b* of the high-pressure turbine 8 are provided in the downstream side of the second shaft 10*b*. The second shaft 10*b* is cylindrical which surrounds the first shaft 10*a* from the outer side in the radial direction and is coaxially provided with the first shaft 10*a*. The second shaft 10*b* is rotated by the rotor blade rows 8*b* of the high-pressure turbine 8 and transmits a rotating power of the high-pressure turbine 8 to the rotor blade rows 6*b* of the high-pressure compressor 6.

The main nozzle 11 is provided on the downstream of the low-pressure turbine 9 and is an opening provided in the most downstream of the jet engine 1. The main nozzle 11 ejects the combustion gas which has passed through the low-pressure turbine 9 to the rear side of the jet engine 1. The thrust of the jet engine 1 is obtained by a reaction when the combustion gas is ejected from the main nozzle 11.

The center vent tube 12 is a straight pipe whose upstream end portion and downstream end portion are open, and is inserted through the first shaft 10*a*. A distal end of the center vent tube 12 is fixed to the narrow portion 10*a*1 of the first shaft 10a by a bolt (not shown), and the center vent tube 12 is rotated with the rotation of the first shaft 10*a*. The center vent tube 12 discharges lubricant which is used at bearings or the like which are not shown from a lubricant closure to the main nozzle 11 together with air. The center vent tube 12 includes an enlarged diameter portion 12*a* which corresponds to a location where a center vent tube aligning mechanism 13 is provided (refer to FIG. 2). The enlarged diameter portion 12*a* is a segment which protrudes in an outer side in the radial direction of the center vent tube 12 and formed to be thicker than other segments. An annular groove portion 12*b* is formed on a circumferential surface of the enlarged diameter portion 12*a* (refer to FIG. 2).

As shown in FIG. 1, in the present embodiment, the center vent tube aligning mechanism 13 is provided in two locations which are a center portion and a downstream end portion of the center vent tube 12. The center vent tube aligning mechanism 13 slidably aligns the center vent tube 12 in an axial direction and a circumferential direction of the center vent tube 12.

In the jet engine 1 having the above-described configurations, portion of air taken by the rotation of the rotor blade row 4*a* of the fan unit 4 is two-stage compressed by the low-pressure compressor 5 and the high-pressure compressor 6, the compressed air generated by the two-stage compression and the fuel are combusted in the combustor 7, and the combustion gas is generated. The combustion gas passes through the high-pressure turbine 8 and the low-pressure turbine 9 to rotate the shaft 10 and is ejected rearward from the main nozzle 11, and a thrust is obtained. The center vent tube 12 discharges air including the lubricant to the main nozzle 11.

Figure 2:
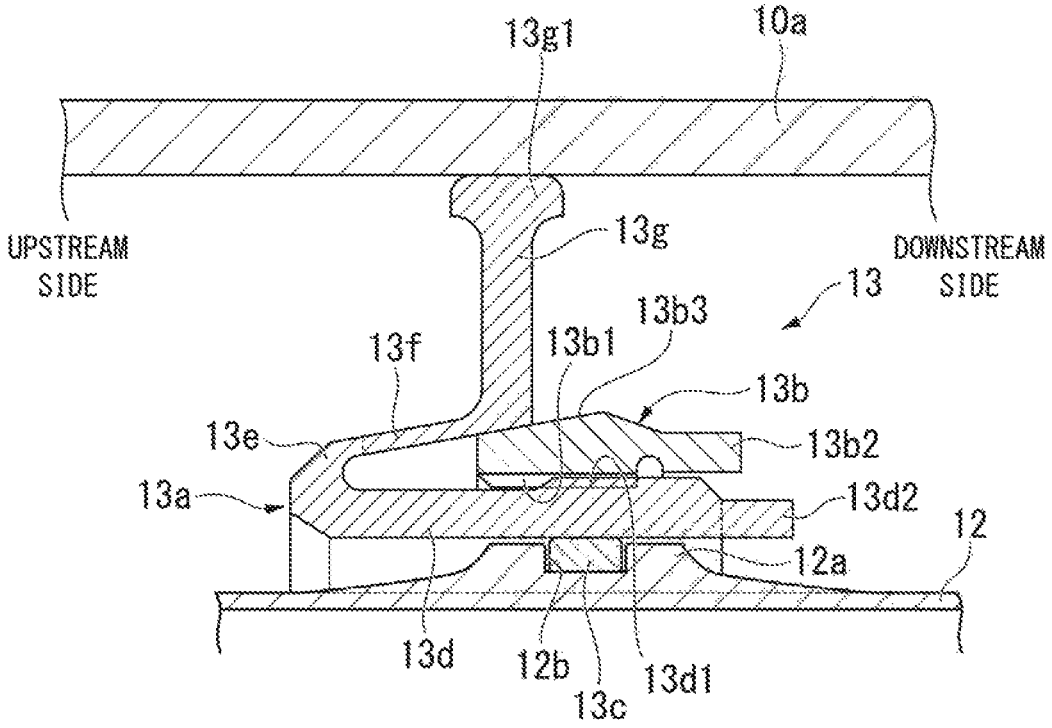
FIG. 2 is a partially enlarged sectional view including a portion of the center vent tube aligning mechanism in accordance with the first embodiment of the present disclosure.
Figure 3:
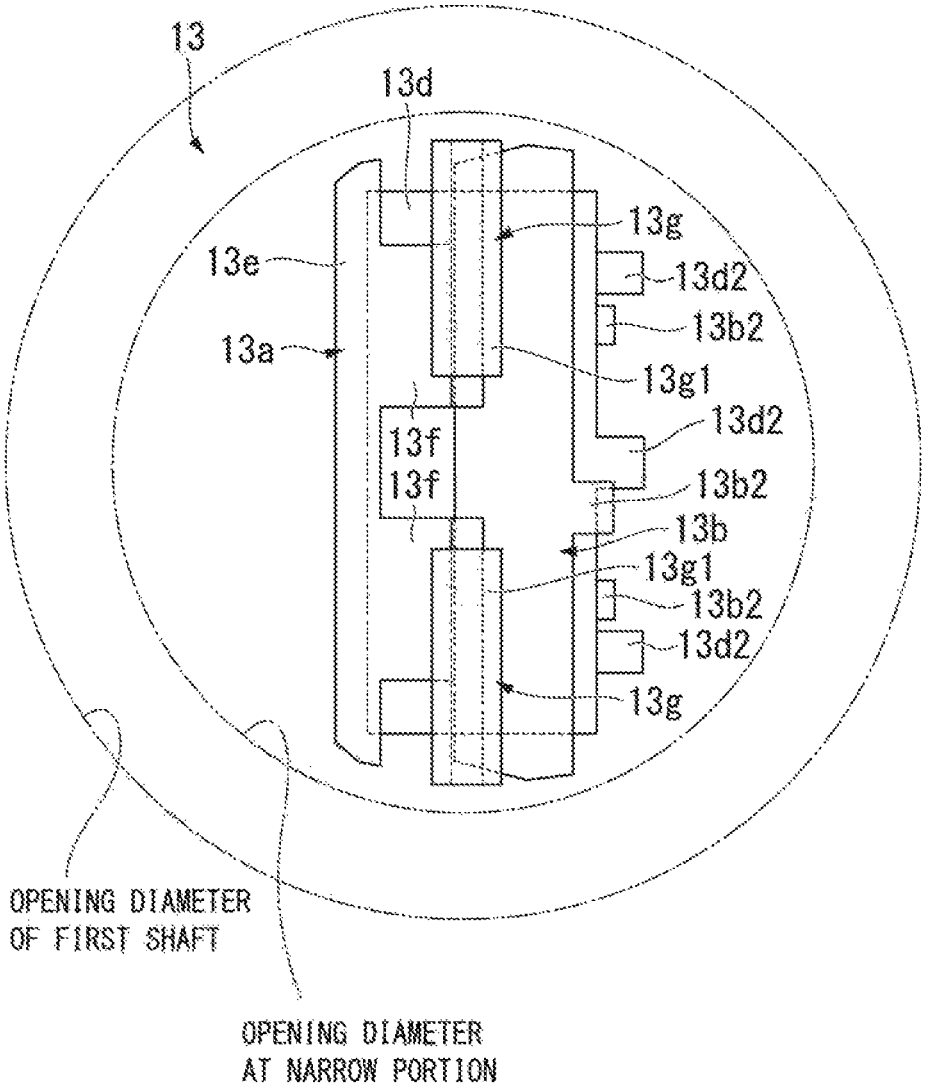
FIG. 3 is a side view of the center vent tube aligning mechanism in accordance with the first embodiment of the present disclosure viewed from an outer side in a radial direction of the center vent tube aligning mechanism.

Next, a detailed configuration of the center vent tube aligning mechanism 13 will be described with reference to FIGS. 2 to 5. FIG. 2 is a partially enlarged sectional view including portion of the center vent tube aligning mechanism 13. FIG. 3 is a side view of the center vent tube aligning mechanism 13 viewed from an outer side in the radial direction of the center vent tube aligning mechanism 13. As shown on these drawings, the center vent tube aligning mechanism 13 includes a sleeve unit portion 13*a* (integrated member), a nut 13*b*, and a spacer ring 13*c*.

Figure 4:
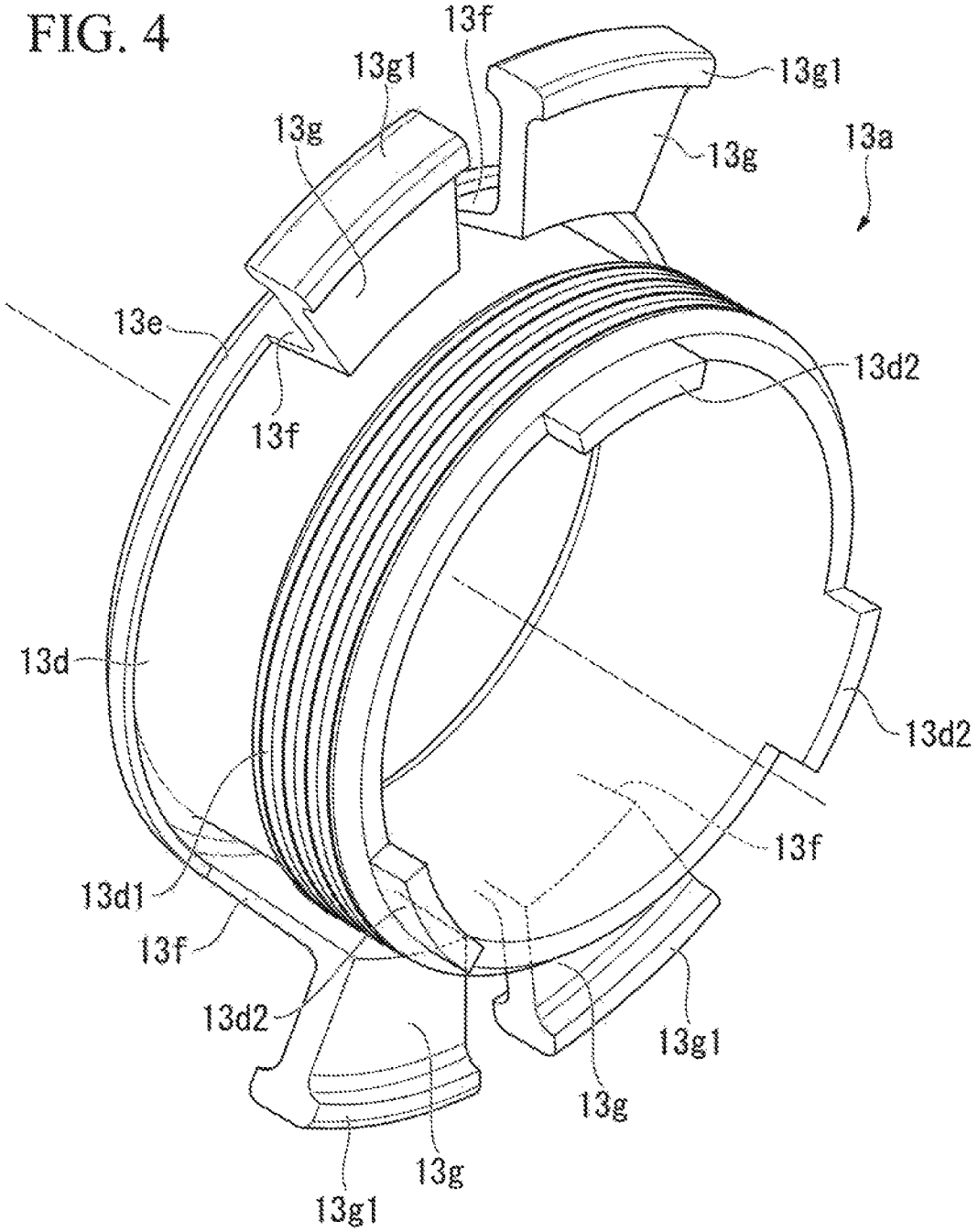
Figure 5:
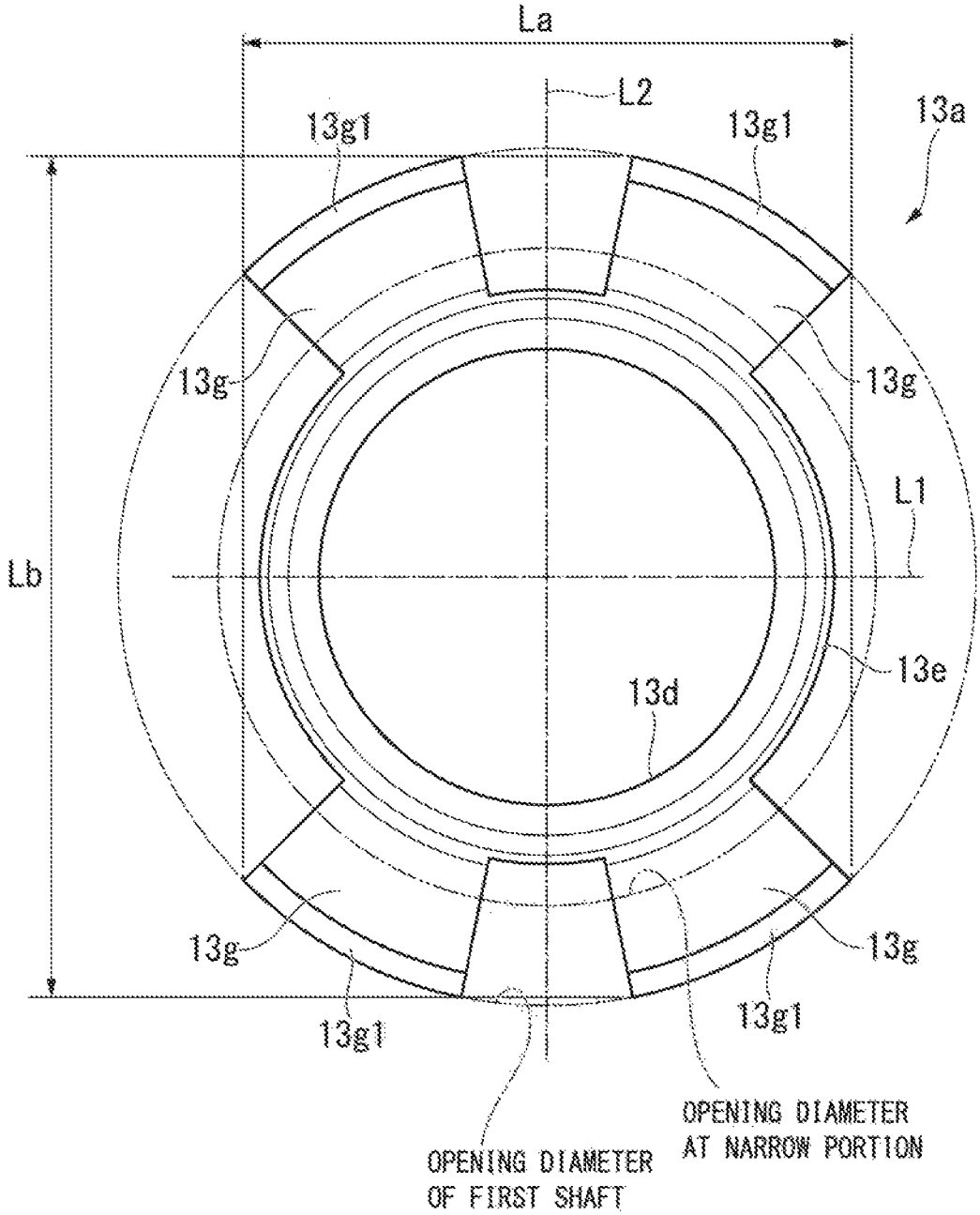

FIG. 4 is a perspective view of a sleeve unit portion 13*a*. FIG. 5 is a front view of a sleeve unit portion 13*a*. As shown on these drawings, the sleeve unit portion 13*a* is an integrated member where the sleeve 13*d*, an annular portion 13*e*, a connection portion 13*f* (flexible portion), and a support portion 13*g* (abutting portion) are integrated. The sleeve 13*d* is a cylindrical segment which surrounds the center vent tube 12 from the outer side in the radial direction of the center vent tube 12. An inner diameter of the sleeve 13*d* is slightly greater than an outer diameter of the enlarged diameter portion 12*a* of the center vent tube 12. Accordingly, a slight gap is provided between the sleeve 13*d* and the enlarged diameter portion 12*a* of the center vent tube 12. A thread groove 13*d*1 with which the nut 13*b* is screwed together is formed on an outer circumferential surface of the downstream side of the sleeve 13*d*. Three protrusions 13*d*2 protruded to the downstream are provided in the downstream end portion of the sleeve 13*d* so as to be scattered in the circumferential direction of the sleeve 13*d*. The protrusions 13*d*2 are segments that a worker grasps so as to prevent the sleeve unit portion 13*a* from moving against the first shaft 10*a* when the nut 13*b* is screwed together with the thread groove 13*d*1.

The annular portion 13*e* is an annular segment which is coaxially provided with the sleeve 13*d*. The annular portion 13*e* is provided to be integrated with an upstream end portion of the sleeve 13*d*. An outer diameter of the annular portion 13*e* is greater than that of the sleeve 13*d* so that the annular portion 13*e* protrudes in an outer side in the radial direction of the sleeve 13*d* than the sleeve 13*d*. The annular portion 13*e* is coaxially provided with the center vent tube 12. The connection portion 13*f* is a plate segment which is capable of elastic deformation provided so as to protrude downstream from an edge portion of the annular portion 13*e* in an outer side in the radial direction of the annular portion 13*e*. The support portion 13*g* is connected to a distal end portion in the downstream of the connection portion 13*f*. The thickness of the connection portion 13*f* in the radial direction of the sleeve 13*d* is set to be thinner than the thickness of the sleeve 13*d* or the like so that the connection portion 13*f* are easily deformed in the radial direction of the sleeve 13*d*. By the connection portion 13*f*, since the connection portion 13*f* is elastically deformed by a weak force, the support portion 13*g* is movably supported in the radial direction of the sleeve 13*d*. As shown in FIGS. 4 and 5, four connection portions 13*f* are provided in the circumferential direction of the sleeve 13*d*. That is, a plurality of the connection portions 13*f* is discretely provided in the circumferential direction of the sleeve 13*d*. Two of the four connection portions 13*f* are provided in an upper portion of the sleeve 13*d* and the other two connection portions 13*f* are provided in a lower portion of the sleeve 13*d*. That is, in the four connection portions 13*f*, the same number (two) of the connection portions 13*f* are provided in the upper portion and the lower portion of the sleeve 13*d* but not in a side portion of the sleeve 13*d*.

The support portion 13*g* is provided to protrude to the outer side in the radial direction of the sleeve 13*d* from distal end portion of each connection portion 13*f* and a distal end portion 13*g*1 of the support portion 13*g* abuts an inner circumferential surface of the first shaft 10*a*. The support portion 13*g* is supported by each connection portion 13*f* in a state in which a fixed gap is provided between the outer circumferential surface of the sleeve 13*d* and the support portion 13*g*. The support portion 13*g* is provided in the outer side of the sleeve 13*d* in the radial direction thereof than the thread groove 13*d*1 provided in the sleeve 13*d*. An end portion of the support portion 13*g* in an inner side in a radial direction of the support portion 13*g* abuts an outer circumferential surface (a tapered surface 13*b*3 described later) of the nut 13*b*. The support portion 13*g* is pushed out to the outer side in the radial direction of the sleeve 13*d* by the outer circumferential surface of the nut 13*b*. Accordingly, the inner circumferential surface of the first shaft 10*a* is pushed from the inner side in the radial direction of the first shaft 10*a*. As described above, one support portion 13*g* is provided in each connection portion 13*f*. In the present embodiment, in the same manner as the connection portions 13*f*, four support portions 13*g* are provided. In the same manner as the connection portions 13*f*, in these four support portions 13*g*, the same number (two) of the support portions 13*g* are provided in the upper portion and the lower portion of the sleeve 13*d* but not in the side portion of the sleeve 13*d*.

If one connection portion 13*f* and one support portion 13*g* connected to the one connection portion 13*f* are regarded as a pair, in the present embodiment, the same number (two) of pairs are provided in the upper portion and the lower portion of the sleeve 13*d* but not in the side portion of the sleeve 13*d*. The disposition of the pairs is determined based on the maximum dimension of the sleeve unit portion 13*a*. For example, as shown in FIG. 5, a horizontal axis L1 (first axis) which passes a center of the sleeve 13*d* and is elongated along the radial direction of the sleeve 13*d* and a vertical axis L2 (second axis) which is orthogonal to the horizontal axis L1 at the center of the sleeve 13*d* are set. The disposition of the pairs are such that the maximum dimension La of the sleeve unit portion 13*a* in a direction along the horizontal axis L1 is smaller than an opening diameter at the narrow portion 10*a*1, and the maximum dimension Lb of the sleeve unit portion 13*a* in a direction along the vertical axis L2 is approximately the same as the inner diameter of the first shaft 10*a*. In this manner, the dimension of the sleeve unit portion 13*a* is set such that the maximum dimension La in the horizontal direction is smaller than the maximum dimension Lb in the vertical direction.

According to the sleeve unit portion 13*a*, the maximum dimension La of the sleeve unit portion 13*a* in the horizontal direction is smaller than the opening diameter at the narrow portion 10*a*1. Accordingly, by laying down the sleeve unit portion 13*a* such that the horizontal axis L1 thereof directs the radial direction of the first shaft 10*a* and the vertical axis L2 thereof is parallel with the center axis of the first shaft 10*a* (not shown), it is possible to insert the sleeve unit portion 13*a* into the first shaft 10*a* and to remove the sleeve unit portion 13*a* from the inside of the first shaft 10*a* without the sleeve unit portion 13*a* interfering with the narrow portion 10*a*1 of the first shaft 10*a*.

A thread groove 13*b*1 is provided in an inner circumferential surface of the nut 13*b* and is screwed together with the thread groove 13*d*1 of the sleeve unit portion 13*a*. Three protrusions 13*b*2 which protrudes to the downstream are provided in a downstream end portion of the nut 13*b* so as to be scattered in the circumferential direction of the nut 13*b*. The protrusions 13*b*2 are segments that a worker grasps so as to rotate the nut 13*b* to be screwed together with the sleeve 13*d*. In an outer circumferential surface of the nut 13*b* in the upstream side of the nut 13*b*, a tapered surface 13*b*3, in which the outer circumferential surface thereof is enlarged in an outer side in the radial direction of the nut 13*b* toward the downstream, is provided. As shown in FIG. 2, the tapered surface 13*b*3 abuts the support portion 13*g* from the inner side in the radial direction of the support portion 13*g*. Since the annular portion 13*e* or the like which protrudes in the outer side in the radial direction of the sleeve 13*d* is provided to an upstream end portion of the sleeve 13*d* to which the thread groove 13*d*1 is provided, it is not possible to screw the nut 13*b* together with the sleeve 13*d* from the upstream of the sleeve 13*d*. Accordingly, the nut 13*b* is screwed together with the sleeve 13*d* from the downstream of the sleeve 13*d*.

When the nut 13*b* is rotated so as to screw the nut 13*b* together with the sleeve 13*d* from the downstream, the nut 13*b* is inserted into the gap between the sleeve 13*b* and the support portions 13*g*. For example, when the nut 13*b* is rotated by grasping the protrusions 13*d*2 and fixing the sleeve unit portion 13*a* so that the sleeve unit portion 13*a* does not move, the nut 13*b* is moved to the upstream as an amount of the nut 13*b* screwed together (the length in the axial direction of the sleeve 13*d* in which the thread groove 13*b*1 and the thread groove 13*d*1 are screwed together) increases. At the same moment, the tapered surface 13*b*3 is moved upstream in accordance with the movement of the nut 13*b*. Accordingly, the height of the tapered surface 13*b*3 with respect to the support portions 13*g* increases, and a pushing force toward the support portions 13*g* from the nut 13*b* increases. That is, in the present embodiment, the pushing force toward the support portions 13*g* changes in accordance with the amount of the nut 13*b* screwed together.

When the support portions 13*g* are pushed by the nut 13*b* as described above, since the support portions 13*g* abut the inner circumferential surface of the first shaft 10*a*, the support portions 13*g* receive reaction force from the inner circumferential surface of the first shaft 10*a*. The reaction force is transmitted to she sleeve 13*d* via the nut 13*b*. That is, the sleeve 13*d* is pushed to an inner side in the radial direction of the sleeve 13*d* by the reaction force. Here, a plurality (four in the present embodiment) of the support portions 13*g* is discretely provided in the circumferential direction of the sleeve 13*d*. Accordingly, the sleeve 13*d* is pushed to the inner side in the radial direction of the sleeve 13*d* from a plurality of locations in the circumferential direction by the reaction force, and the sleeve 13*d* is fixed coaxially with the first shaft 10*a*.

The spacer ring 13*c* is accommodated in the groove portion 12*b* which is provided in the enlarged diameter portion 12*a* of the center vent tube 12. The thickness of the spacer ring 13*c* is set to be greater than the depth of the groove portion 12*b*. An outer circumferential surface of the spacer ring 13*c* is located in an outer side of the spacer ring 13*c* in the radial direction thereof than an outer circumferential surface of the enlarged diameter portion 12*a*. The outer circumferential surface of the spacer ring 13*c* abuts an inner circumferential surface of the sleeve 13*d*. The spacer ring 13*c* is formed of a material having a high elastic modulus and superior wear resistance such as polytetrafluoroethylene, a polyimide resin, or the like. The spacer ring 13*c* prevents the center vent tube 12 from contacting the sleeve 13*d*. Furthermore, the spacer ring 13*c* keeps the center vent tube 12 movable against the sleeve 13*d* in the axial and circumferential directions of the center vent tube 12.

The center vent tube aligning mechanism 13 configured as described above makes the axis of the center vent tube 12 coincide with the axis of the first shaft 10*a* with the spacer ring 13*c* which is attached to the center vent tube 12 abutting the sleeve 13*d* which is fixed coaxially with the first shaft 50*a* furthermore, in the center vent tube aligning mechanism 13, since the spacer ring 13*c* is slidable with respect to the sleeve 13*d*, the center vent tube 12 is movable in the axial direction and the circumferential direction of the center vent tube 12.

In the center vent tube aligning mechanism 13 in accordance with the present embodiment, the support portions 13*g* which abut the inner circumferential surface of hollow first shaft 10*a* is provided, the reaction force that the support portions 13*g* receive from the inner circumferential surface of the first shaft 10*a* is transmitted to the sleeve 13*d* as a retention force, and the sleeve 13*d* is retained by the retention force. Furthermore, the support portions 13*g* are connected to the annular portion 13*e*, which is provided coaxially with the center vent tube 12, via the connection portions 13*f* which protrude along the axis direction of the center vent tube 12. The support portions 13*g* move along the radial direction of the center vent tube 12 with the connection portions 13*f* deforming when the support portions 13*g* are pushed from an inner side in the radial direction of the center vent tube 12 to the outer side in the radial direction of the center vent tube 12. Accordingly, when the support portions 13*g* are pushed to the outer side in the radial direction of the center vent tube 12 in order to generate a retention force of the sleeve 13*d*, the support portions 13*g* are always pushed from a direction orthogonal to the inner circumferential surface of the first shaft 10*a*. Therefore, a whole distal end of one support portion 13*g* is pushed front the inner circumferential surface of the first shaft 10*a* by equal force. As a result, the reaction force (the retention force of the sleeve 13*d*) that the one support portion 13*g* receives from the inner circumferential surface of the first shaft 10*a* is equal in the circumferential direction of the sleeve 13*d*. Accordingly, in accordance with the center vent tube aligning mechanism 13 of the present embodiment, since it is possible to prevent the balance of the retention force of the sleeve 13*d* from collapsing with the retention force of the sleeve 13*d* being biased, it is possible to prevent deformation or dislocation of the sleeve 13*d*. Therefore, in accordance with the center vent tube aligning mechanism 13 of the present embodiment, since it is possible to keep the gap between the sleeve 13*d* and the center vent tube 12 uniform in the circumferential direction, it is possible to prevent abrasion or the like from occurring locally in the center vent tube 12.

Furthermore, in the center vent tube aligning mechanism 13 of the present embodiment, two support portions 13*g* are provided in each of the upper portion and the lower portion of the sleeve 13*d*. As shown in FIG. 5, these support portions 13*g* are provided in upper and lower symmetry and in left-right symmetry. Accordingly, the retention force applied from upward to the sleeve 13*d* and the retention force applied from downward to the sleeve 13*d* balance, and the retention force applied from left side to the sleeve 13*d* and the retention force applied from right side to the sleeve 13*d* balance. Therefore, it is possible to retain the sleeve 13*d* with more uniform forces. Accordingly, in accordance with the center vent tube aligning mechanism 13 of the present embodiment, it is possible to prevent deformation or dislocation of the sleeve 13*d* more reliably. That is, instead of the conventional support ring (provided with a slit) where portion thereof in circumferential direction is cut out, since the support portion 13*g* where portion thereof in circumferential direction is not cut out is shaped in line symmetry with respect to two axes intersecting in 90 degrees, it is possible to align the center vent tube 12 more accurately.

In the center vent tube aligning mechanism 13 of the present embodiment, a plurality of pairs of one connection portion 13*f* and one support portion 13*g* connected to the connection portion 13*f* are discretely provided in the circumferential direction of the sleeve 13*d*. That is, in the center vent tube aligning mechanism 13 of the present embodiment, the connection portions 13*f* and the support portions 13*g* are provided by being finely scattered in the circumferential direction. Accordingly, even if the connection portion 13*f* is deformed in one pair, the deformation of the connection portion 13*f* does not influence other connection portions 13*f* in other pairs. That is, each connection portion 13*f* can deform without influencing or being influenced by other connection portions 13*f*. If the connection portions 13*f* are connected together in the circumferential direction, deformation in one connection portion 13*f* deforms other connection portions 13*f*, it is possible that the support portions 13*g* may move in directions which are out of the radial direction of the sleeve 13*d*. On the other hand, in the center vent tube aligning mechanism 13 of the present embodiment, since deformation of one connection portion 13*f* does not influence other connection portions 13*f*, it is possible to more reliably move the support portion 13*g* along the radial direction of the sleeve 13*d*. Accordingly, in the center vent tube aligning mechanism 13 of the present embodiment, it is possible to prevent deformation or dislocation of the sleeve 13*d* more reliably.

In the center vent tube aligning mechanism 13 of the present embodiment, the sleeve 13*d*, the annular portion 13*e*, the connection portions 13*f*, and the support portions 13*g* are integrated together. Accordingly, for example, compared to a case where the sleeve 13*d* is provided as a different body from the annular portion 13*e*, the connection portions 13*f*, and the support portions 13*g*, it is possible to reduce the number of components and to reduce the man-hours needed for manufacture.

In the center vent tube aligning mechanism 13 of the present embodiment, the tapered surface 13*b*3 is provided in the nut 13*b*. Accordingly, the reaction force that the support portions 13*g* receive from the tapered surface 13*b*3 is transmitted to the sleeve 13*d* via the nut 13*b*. Therefore, the reaction force is scattered in the circumferential direction of the sleeve 13*d* in the nut 13*b*, and it is possible to more reliably prevent deformation or dislocation of the sleeve 13*d*.

In the center vent tube aligning mechanism 13 of the present embodiment disposition of the above-described pairs are determined such that the maximum dimension La of the sleeve unit portion 13*a* in a direction along the horizontal axis L1 is smaller than the opening diameter at the narrow portion 10*a*1, and the maximum dimension Lb of the sleeve unit portion 13*a* in a direction along the vertical axis L2 is approximately the same as the issuer diameter of the first shaft 10*a*. Accordingly, by laying down the sleeve unit portion 13*a*, it is possible to insert the sleeve unit portion 13*a* into the first shaft 10*a* and to remove the sleeve unit portion 13*a* from the inside of the first shaft 10*a* without the sleeve unit portion 13*a* interfering with the narrow portion 10*a*1 of the first shaft 10*a*. Therefore, it is possible to insert the sleeve unit portion 13*a* into the inside of the first shaft 10*a* and to remove the sleeve unit portion 13*a* from the inside of the first shaft 10*a* from both the upstream and the downstream of the first shaft 10*a*.

(Second Embodiment)

Next, a second embodiment of the present disclosure will be described. In the description of this embodiment, for parts the same as those in the first embodiment, the description thereof is omitted or simplified.

Figure 6:
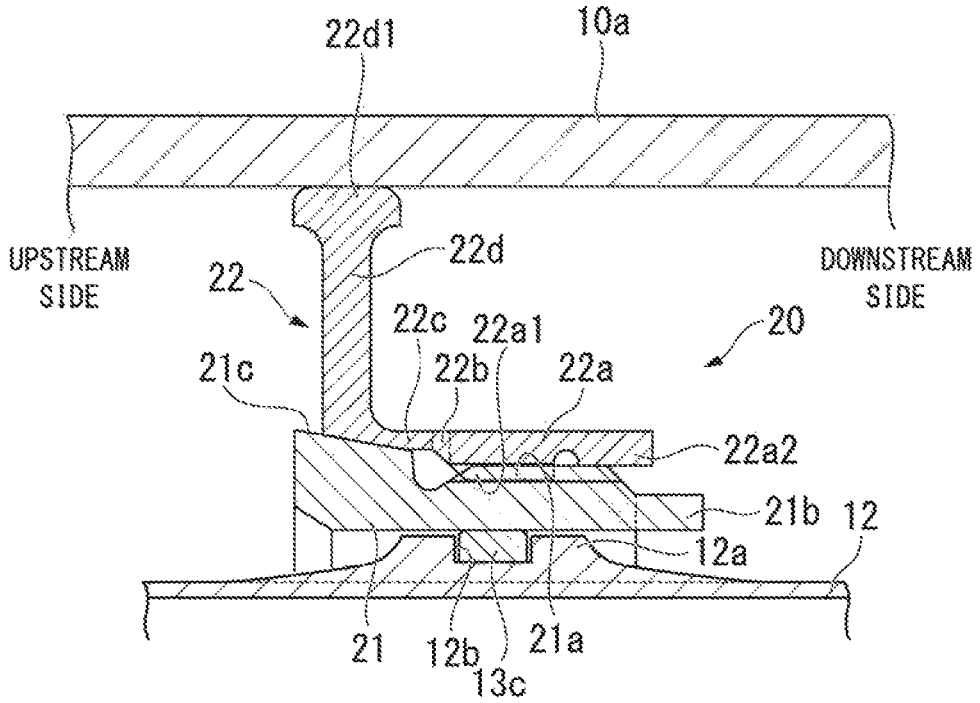
FIG. 6 is a partially enlarged sectional view including a portion of the center vent tube aligning mechanism in accordance with a second embodiment of the present disclosure.
Figure 7:
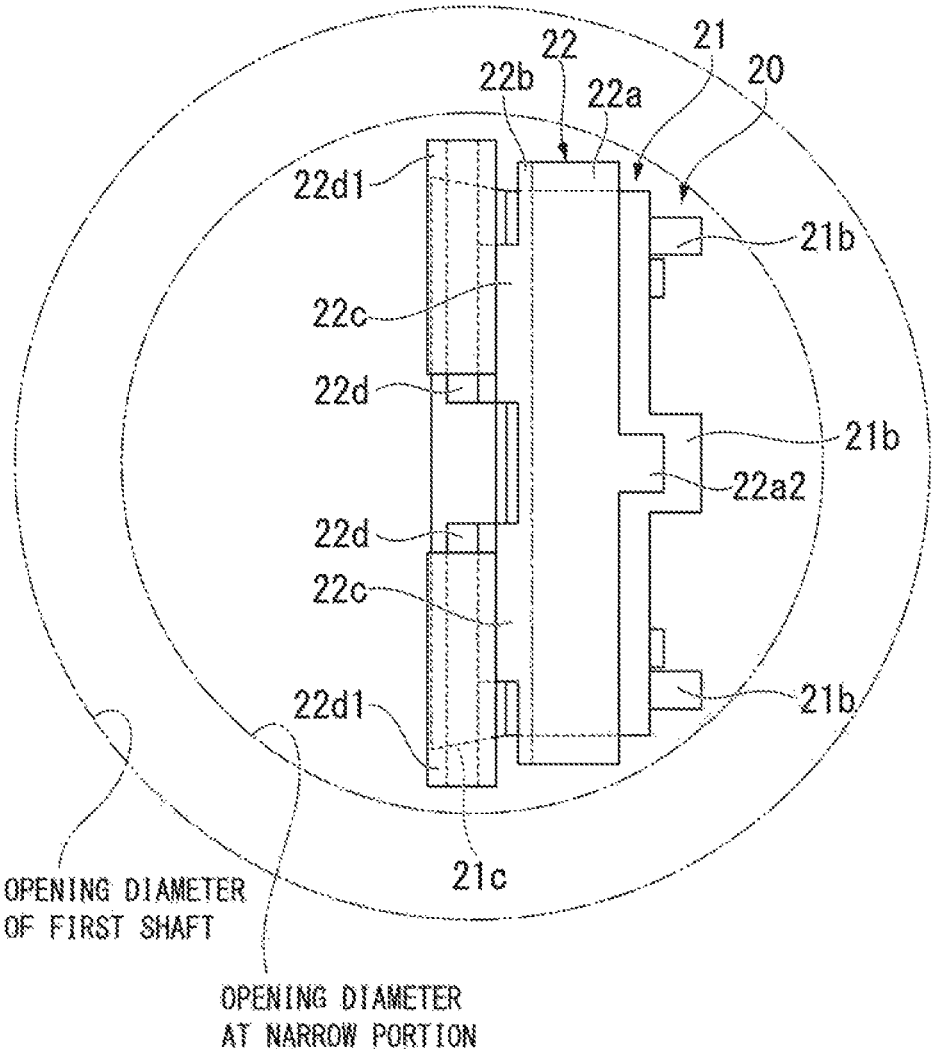
FIG. 7 is a side view of the center vent tube aligning mechanism in accordance with the second embodiment of the present disclosure viewed from an outer side in the radial direction of the center vent tube aligning mechanism.

FIG. 6 is a partially enlarged sectional view including portion of the center vent tube aligning mechanism 20. FIG. 7 is a side view of the center vent tube aligning mechanism 20 viewed from an outer side in the radial direction of the center vent tube aligning mechanism 20. As shown in these drawings, the center vent tube aligning mechanism 20 of the present embodiment includes a sleeve 21, a nut unit portion 22 (integrated member), and the above-described spacer ring 13*c*.

A thread groove 21*a* with which a nut 22*a* is screwed together is formed on an outer circumferential surface of the downstream side of the sleeve 21. Three protrusions 21*b* protruded to the downstream are provided in the downstream end portion of the sleeve 21 so as to be scattered in the circumferential direction of the sleeve 21. In the present embodiment, the nut 22*a* is screwed together with the thread groove 21*a* by rotating the sleeve 21. The protrusions 21*b* are segments that a worker grasps so as to rotate the sleeve 21 when the worker screws the nut 22*a* together with the thread groove 21*a*. On an outer circumferential surface of the sleeve 21 in the upstream side of the sleeve 21, a tapered surface 21*c*, in which the outer circumferential surface thereof is enlarged in an outer side in the radial direction of the sleeve 21 to the upstream, is provided. As shown in FIG. 6, the tapered surface 21*c* abuts a support portion 22*d* (abutting portion) of the nut unit portion 22, which will be described later, from an inner side in the radial direction of the sleeve 21.

The nut unit portion 22 is a member in which the nut 22*a*, an annular portion 22*b*, a connection portion 22*c* (flexible portion), and the support portion 22*d* are integrated. A thread groove 22*a*1 is provided on an inner circumferential surface of the nut 22*a*. The thread groove 21*a* of the sleeve 21 is screwed together with the thread groove 22*a*1. Three protrusions 22*a*2 which protrude downstream are provided in the downstream end portion of the nut 22*a* so as to be scattered in the circumferential direction of the nut 22*a*. The protrusions 22*a*2 are segments that a worker grasps so as to prevent the nut unit portion 22 from moving when the worker rotates the sleeve 21 as described above.

The annular portion 22*b* is an annular segment which is coaxially provided with the nut 22*a*. The annular portion 22*b* is integrally connected to an upstream end portion of the nut 22*a*. The connection portion 22*c* is a plate segment which is capable of elastic deformation provided so as to protrude upstream from an edge portion of the annular portion 22*b* in an outer side in the radial direction of the annular portion 22*b*. The support portion 22*d* is connected to a distal end portion in the upstream of the connection portion 22*c*. The thickness of the connection portion 22*c* in the radial direction of the nut 22*a* is thinner than the thickness of the nut 22*a* or the like so that the connection portion 22*c* is easily deformed in the radial direction of the nut 22*a*. By the connection portion 22*c*, since the connection portion 22*c* is elastically deformed by a weak force, the support portion 22*d* is movably supported in the radial direction of the nut 22*a*. Four connection portions 22*c* are provided in the circumferential direction of the nut 22*a*. That is, a plurality of the connection portions 22*c* are discretely provided in the circumferential direction of the nut 22*a* (circumferential direction of the sleeve 21). Two of the four connection portions 22*c* are provided in an upper portion of the nut 22*a* and the other two connection portions 22*c* are provided in a lower portion of the nut 22*a*. That is, in the four connection portions 22*c* the same number (two) of the connection portions 22*c* are provided in the upper portion and the lower portion of the nut 22*a* but not in a side portion of the nut 22*a*.

The support portion 22*d* is provided to protrude to an outer side in the radial direction of the nut 22*a* from distal end portions of each connection portions 22*c*, and a distal end portion 22*d*1 of the support portion 22*d* abuts the inner circumferential surface of the first shaft 10*a*. An end portion of the support portion 22*d* in an inner side in the radial direction of the support portion 22*d* abuts the tapered surface 21*c* of the sleeve 21. The support portion 22*d* is pushed to the outer side in the radial direction of the not 22*a* by the outer circumferential surface of the sleeve 21. Accordingly, the inner circumferential surface of the first shaft 10*a* is pushed from the inner side in the radial direction of the first shaft 10*a*. As described above, one support portion 22*d* is provided in each connection portion 22*c*. In the present embodiment, in the same manner as the connection portions 22*c*, four support portions 22*d* are provided. In the same manner as the connection portions 22*c*, in these four support portions 22*d*, the same number (two) of the support portions 22*d* are provided in the upper portion and the lower portion of the nut 22*a* but not in the side portion of the nut 22*a*.

In the nut unit portion 22, in the same manner as the connection portions 13*f* and the support portions 13*g* of the first embodiment, the connection portions 22*c* and the support portions 22*d* are disposed such that the maximum dimension of the nut unit portion 22 in a direction along the horizontal axis of the nut unit portion 22 is smaller than the opening diameter at the narrow portion 10*a*1, and the maximum dimension of the nut unit portion 22 in a direction along the vertical axis of the nut unit portion 22 is approximately the same as the inner diameter of the first shaft 10*a*. Accordingly, by laying down the nut unit portion 22, it is possible to insert the nut unit portion 22 into the first shaft 10*a* and to remove the nut unit portion 22 from the inside of the first shaft 10*a* without the nut unit portion 22 interfering with the narrow portion 10*a*1 of the first shaft 10*a*.

In the center vent tube aligning mechanism 20, when the sleeve 21 is rotated from the upstream in a state that the nut unit portion 22 is fixed, the sleeve 21 is moved to the downstream as an amount of the sleeve 21 screwed together increases. At the same moment, the tapered surface 21*c* is also moved to downstream in accordance with the movement of the sleeve 21. Accordingly, the height of the tapered surface 21*c* with respect to the support portions 22*d* increases, and a pushing force toward the support portions 22*d* from the sleeve 21 increases. That is, the pushing force toward the support portions 22*d* changes in accordance with the amount of the sleeve 21 screwed together.

When the support portions 22*d* are pushed by the sleeve 21 as described above, since the support portions 22*d* abut the inner circumferential surface of the first shaft 10*a*, the support portions 22*d* receive reaction force from the inner circumferential surface of the first shaft 10*a*. The reaction force is transmitted to the sleeve 21. That is, the sleeve 21 is pushed to the inner side in the radial direction of the sleeve 21 by the reaction force. Here, a plurality (four in the present embodiment) of the support portions 22*d* is discretely provided in the circumferential direction of the sleeve 21. Accordingly, the sleeve 21 is pushed to the inner side in the radial direction of the sleeve 21 from a plurality of locations in the circumferential direction of the sleeve 21 by the reaction force and the sleeve 21 is fixed coaxially with the first shaft 10*a*.

In the center vent tube aligning mechanism 20 in accordance with the present embodiment, the support portions 22*d* which abut the inner circumferential surface of hollow first shaft 10*a* is provided, the reaction force that the support portions 22*d* receive from the inner circumferential surface of the first shaft 10*a* is transmitted to the sleeve 21 as a retention force, and the sleeve 21 is retained by the retention force. Furthermore, the support portions 22*d* are connected to the annular portion 22*b*, which is provided coaxially with the center vent tube 12, via the connection portions 22*c* which protrude along the axis direction of the center vent tube 12. The support portions 22*d* move along the radial direction of the center vent tube 12 with the connection portions 22*c* deforming when the support portions 22*d* are pushed from the inner side in the radial direction of the center vent tube 12 to the outer side in the radial direction of the center vent tube 12. Accordingly, when the support portions 22*d* are pushed to the outer side in the radial direction of the center vent tube 12 in order to generate a retention force of the sleeve 21, the support portions 22*d* are always pushed from a direction orthogonal to the inner circumferential surface of the first shaft 10*a*. Therefore, a whole distal end of one support portion 22*d* is pushed from the diner circumferential surface of the first shaft 10*a* by equal force. As a result, the reaction force (the retention force of the sleeve 21) that the one support portion 22*d* receives from the inner circumferential surface of the first shaft 10*a* is equal in the circumferential direction of the sleeve 21. Accordingly, in accordance with the center vent tube aligning mechanism 20 of the present embodiment, since it is possible to prevent the retention force of the sleeve 21 from becoming large locally in the circumferential direction of the sleeve 21 with the retention force of the sleeve 21 being biased, it is possible to prevent deformation or dislocation of the sleeve 21. Therefore, in accordance with the center vent tube aligning mechanism 20 of the present embodiment, since it is possible to make a gap between the sleeve 21 and the center vent tube 12 uniform in the circumferential direction, it is possible to prevent abrasion or the like occurring locally in the center vent tube 12.

Furthermore, in the center vent tube aligning mechanism 20 of the present embodiment, two support portions 22*d* are provided in each of the upper portion and the lower portion of the nut 22*a* so as to be disposed in upper and lower symmetry and in left-right symmetry. Accordingly, the retention force applied from upward to the sleeve 21 and the retention force applied from downward to the sleeve 21 balance, and the retention force applied from left side to the sleeve 21 and the retention force applied from right side to the sleeve 21 balance. Therefore, it is possible to retain the sleeve 21 with more equal forces. Accordingly, in accordance with the center vent tube aligning mechanism 20 of the present embodiment, it is possible to prevent deformation or dislocation of the sleeve 21 more reliably. That is, instead of the conventional support ring (which is provided with a slit) where portion thereof in circumferential direction is cut out, since the support portion 22*d* where portion thereof in circumferential direction is not cut or it is shaped in line symmetry with respect to two axes intersecting in 90 degrees, it is possible to align the center vent tube 12 more accurately.

In the center vent tube aligning mechanism 20 of the present embodiment, a plurality of pairs of the connection portion 22*c* and one support portion 22*d* connected to the connection portion 22*c* is discretely provided in the circumferential direction of the nut 22*a* (in the circumferential direction of the sleeve 21). That is, in the center vent tube aligning mechanism 20 of the present embodiment, the connection portions 22*c* and the support portions 22*d* are provided by being finely scattered in the circumferential direction. Deformation of one connection portion 22*c* does not influence other connection portions 22*c*, and it is possible to more reliably move the support portion 22*d* along the radial direction of the sleeve 21. Accordingly, in accordance with the center vent tube aligning mechanism 20 of the present embodiment, it is possible to prevent deformation or dislocation of the sleeve 21 more reliably.

In the center vent tube aligning mechanism 20 of the present embodiment, the nut 22*a*, the annular portion 22*b*, the connection portions 22*c*, and the support portions 22*d* are integrated. Accordingly, for example, compared to a case where the nut 22*a* is provided as a different body from the annular portion 22*b*, the connection portions 22*c*, and the support portions 22*d*, it is possible to reduce the number of components and to reduce man-hours needed for manufacture.

(Third Embodiment)

Next, a third embodiment of the present disclosure will be described. In the description of this embodiment for parts the same as those in the first or second embodiment, the description thereof is omitted or simplified.

Figure 8:
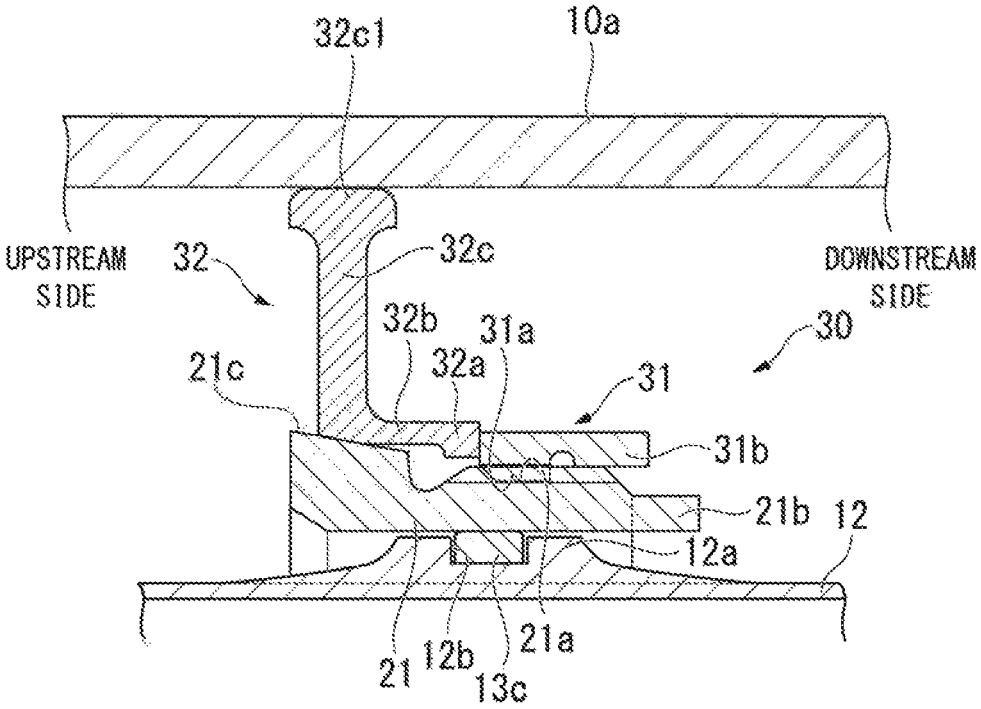
FIG. 8 is a partially enlarged sectional view including portion of the center vent tube aligning mechanism in accordance with a third embodiment of the present disclosure.
Figure 9:
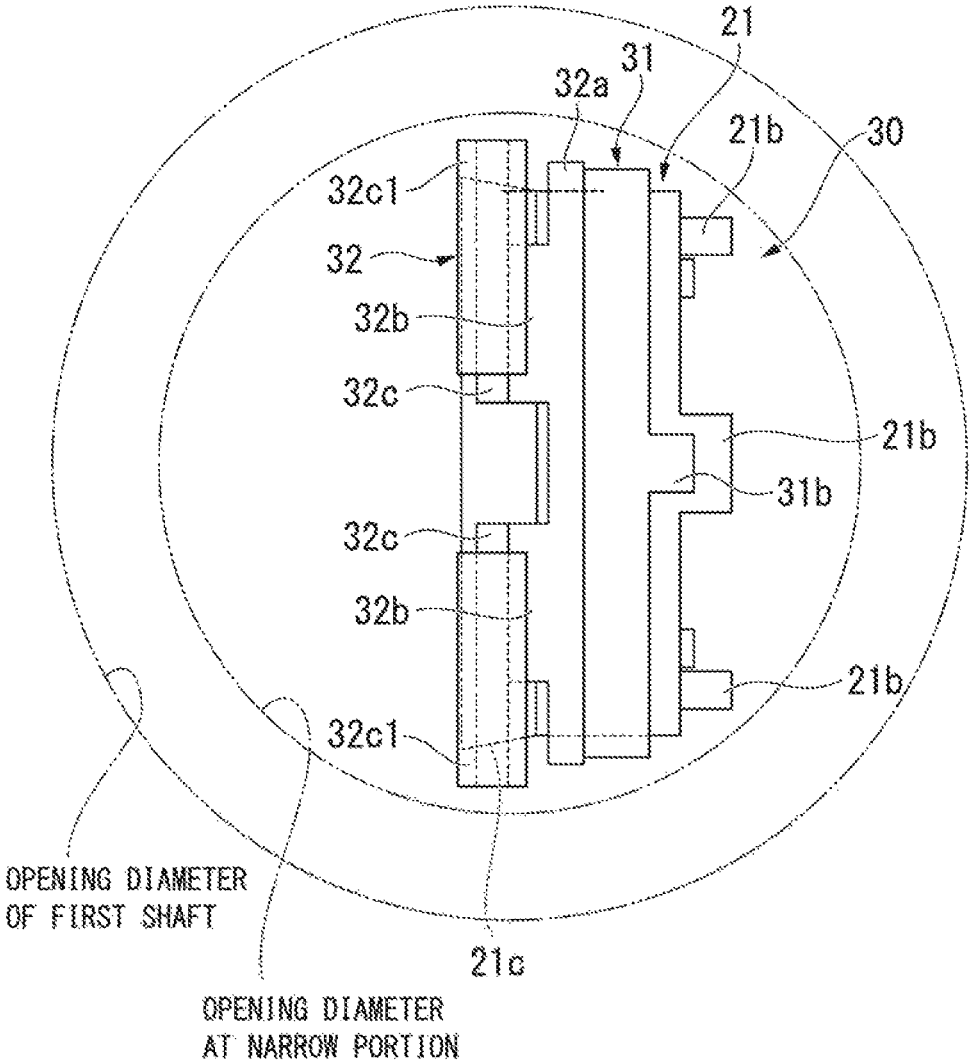
FIG. 9 is a side view of the center vent tube aligning mechanism in accordance with the third embodiment of the present disclosure viewed from an outer side in the radial direction of the center vent tube aligning mechanism.
Figure 10:
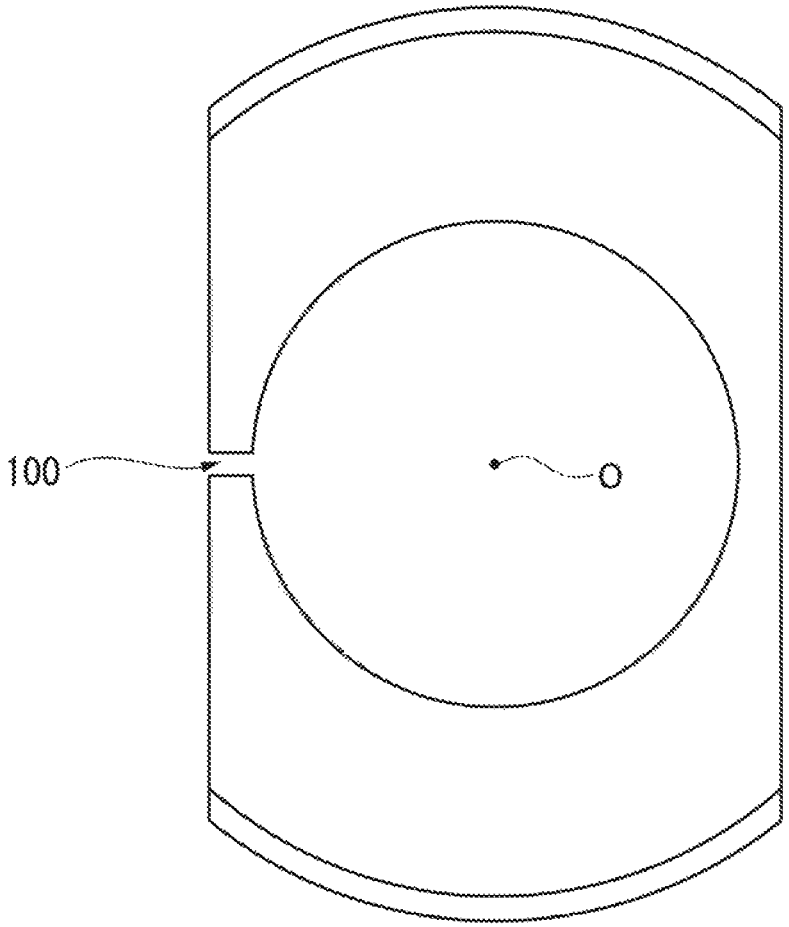
FIG. 10 is a front view of a conventional support ring.

FIG. 8 is a partially enlarged sectional view including portion of the center vent tube aligning mechanism 30. FIG. 9 is a side view of the center vent tube aligning mechanism 30 viewed from an outer side in the radial direction of the center vent tube aligning mechanism 30. As shown in these drawings, the center vent tube aligning mechanism 30 of the present embodiment includes the above-described sleeve 21, a nut 31, a support unit portion 32 (integrated member).

A thread groove 31*a* is provided on an inner circumferential surface of the nut 31 and the nut 31 is screwed together with the sleeve 21. Three protrusions 31*b* protruded to the downstream are provided in the downstream end portion of the nut 31 so as to be scattered in the circumferential direction of the nut 31. The protrusions 31*b* are segments that a worker grasps set as to prevent the nut 31 from rotating in accordance with the rotation of the sleeve 21 when the worker rotates the sleeve 21 as described above. By being screwed together with the thread groove 21*a* of the sleeve 21, the nut 31 pushes the support unit portion 32 to the upstream. Accordingly, the support unit portion 32 and the sleeve 21 are screwed together.

The support unit portion 32 is a member in which the annular portion 32*a*, a connection portion 32*b* (flexible portion), and a support portion 32*c* (abutting portion) are integrated together. The annular portion 32*a* is an annular segment which is coaxially provided with the nut 31. The annular portion 32*a* abuts an upstream end portion of the nut 31. The connection portion 32*b* is a plate segment which is capable of elastic deformation provided so as to protrude to the upstream from an edge portion of the annular portion 33*a* in an outer side in the radial direction of the annular portion 32*a*. The support portion 32*c* is connected to a distal end portion in the upstream of the connection portion 32*b*. The thickness of the connection portion 32*b* in the radial direction of the nut 31 is thinner than the thickness of the nut 31 or the like so that the connection portion 32*b* is easily deformed in the radial direction of the nut 31. By the connection portion 32*b*, since the connection portion 32*b* is elastically deformed by a weak force, the support portion 32*c* is movably supported in the radial direction of the annular portion 32*a*. Four connection portions 32*b* are provided in the circumferential direction of the nut 31. That is, a plurality of the connection portions 32*b* is discretely provided in the circumferential direction of the annular portion 32*a* (circumferential direction of the sleeve 21). Two of the four connection portions 32*b* are provided in an upper portion of the annular portion 32*a* and the other two connection portions 32*b* are provided in a lower portion of the annular portion 32*a*. That is, in the four connection portions 32*b*, the same number (two) of the connection portions 32*b* are provided in the upper portion and the lower portion of the annular portion 32*a* but not in a side portion of the annular portion 32*a*.

The support portion 32*c* is provided to protrude to the outer side in the radial direction of the annular portion 32*a* from distal end portions of each connection portions 32*b*, and a distal end portion 33*c*1 of the support portion 32*c* abuts the inner circumferential surface of the first shaft 10*a*. An end portion of the support portion 32*c* in an inner side in the radial direction of the support portion 32*c* abuts the tapered surface 21*c* of the sleeve 21. The support portion 32*c* is pushed to the outer side in the radial direction of the annular portion 32*a* by the outer circumferential surface of the sleeve 21. Accordingly, the inner circumferential surface of the first shaft 10*a* is pushed from the inner side in the radial direction of the first shaft 10*a*. As described above, one support portion 32*c* is provided in each connection portion 32*b*. In the present embodiment, in the same manner as the connection portions 32*b*, four support portions 32*c* are provided. In the same manner as the connection portions 32*b*, in these four support portions 32*c*, the same number (two) of the support portions 32*c* are provided in the upper portion and the lower portion of the annular portion 32*a* but not in the side portion of the annular portion 32*a*.

In the support unit portion 32, in the same manner as the connection portions 13*f* and the support portions 13*g* of the first embodiment, the connection portions 32*c* and the support portions 32*c* are disposed such that the maximum dimension of the support unit portion 32 in a direction along the horizontal axis of the support unit portion 32 is smaller than the opening diameter at the narrow portion 10*a*1, and the maximum dimension of the support unit portion 32 in a direction along the vertical axis of the support unit portion 32 is approximately the same as the inner diameter of the first shaft 10*a*. Accordingly, by laying down the support unit portion 32, it is possible to insert the support unit portion 32 into the first shaft 10*a* and to remove the support unit portion 32 from the inside of the first shaft without the support unit portion 32 interfering with the narrow portion 10*a*1 of the first shaft 10*a*.

In the center vent tube aligning mechanism 30, when the sleeve 21 is rotated from the upstream in a state that the nut 31 is fixed, the sleeve 21 is moved to the downstream as the amount of the sleeve 21 screwed together increases. At the same moment, the tapered surface 21*c* is moved to the downstream in accordance with the movement of the sleeve 21. Accordingly, the height of the tapered surface 21*c* with respect to the support portions 32*c* increases, and a pushing force toward the support portions 32*c* from the sleeve 21 increases. That is, the pushing force toward the support portions 32*c* changes in accordance with the amount of the sleeve 21 screwed together.

When the support portions 32*c* are pushed by the sleeve 21 as described above, since the support portions 32*c* abut the inner circumferential surface of the first shaft 10*a*, the support portions 32*c* receive reaction force from the inner circumferential surface of the first shaft 10*a*. The reaction force is transmitted to the sleeve 21 as a retention force, and the sleeve 21 is fixed coaxially with the first shaft 10*a* by the retention force.

In the center vent tube aligning mechanism 30 in accordance with the present embodiment, the support portions 32*c* which abut the inner circumferential surface of hollow first shaft 10*a* is provided, the reaction force that the support portions 32*c* receive from the inner circumferential surface of the first shaft 10*a* is transmitted to the sleeve 21 as the retention force, and the sleeve 21 is retained by the retention force. Furthermore, the support portions 32*c* are connected to the annular portion 32*a*, which is provided coaxially with the center vent tube 12, via the connection portions 32*b* which protrude along the axis direction of the center vent tube 12. The support portions 32*c* are moved along the radial direction of the center vent tube 12 with the connection portions 32*b* being deformed when the support portions 32*c* are pushed from the inner side in the radial direction of the center vent tube 12 to the outer side in the radial direction of the center vent tube 12. Accordingly, when the support portions 32*c* are pushed to the outer side in the radial direction of the center vent tube 12 in order to generate the retention force of the sleeve 21, the support portions 32*c* are always pushed from a direction orthogonal to the inner circumferential surface of the first shaft 10*a*. Therefore, a whole distal end of one support portion 32*c* is pushed from the inner circumferential surface of the first shaft 10*a* by equal force. As a result, the reaction force (the retention force of the sleeve 21) that the one support portion 32*c* receives from the inner circumferential surface of the first shaft 10*a* is equal to the circumferential direction of the sleeve 21. Accordingly, in accordance with the center vent tube aligning mechanism 30 of the present embodiment, since it is possible to prevent the retention force of the sleeve 21 from becoming large locally in the circumferential direction of the sleeve 21 with the retention force of the sleeve 21 being biased, it is possible to prevent deformation or dislocation of the sleeve 21. Therefore, in accordance with the center vent tube aligning mechanism 30 of the present embodiment, since it is possible to make a gap between the sleeve 21 and the center vent tube 12 uniform in the circumferential direction, it is possible to prevent abrasion or the like from occurring locally in the center vent tube 12.

Furthermore, in the center vent tube aligning mechanism 30 of the present embodiment, two support portions 32*c* are provided in each of the upper portion and the lower portion of the annular portion 32*a* so as to be disposed in upper and lower symmetry and in left-right symmetry. Accordingly, the retention force applied from upward to the sleeve 21 and the retention force applied from downward to the sleeve 21 balance, and the retention force applied from left side to the sleeve 21 and the retention force applied from right side to the sleeve 21 balance. Therefore, it is possible to retain the sleeve 21 with more equal forces. Accordingly, in accordance with the center vent tube aligning mechanism 30 of the present embodiment, it is possible to prevent deformation or dislocation of the sleeve 21 more reliably. That is, instead of the conventional support ring (which is provided with a slit) where portions thereof in circumferential direction is cut out, since the support portion 32*c* where a portion thereof in circumferential direction is not cutout is shaped in line symmetry with respect to two axes intersecting in 90 degrees, it is possible to align the center vent tube 12 more accurately.

In the center vent tube aligning mechanism 30 of the present embodiment, a plurality of pairs of one connection portion 32*b* and one support portion 32*c* connected to the connection portion 32*b* are discretely provided in the circumferential direction of the annular portion 32*a* (in the circumferential direction of the sleeve 21). That is, in the center vent tube aligning mechanism 30 of the present embodiment, the connection portions 32*b* and the support portions 32*c* are provided by being finely scattered in the circumferential direction. Since deformation of one connection portion 32*b* does not influence other connection portions 32*b*, it is possible to more reliably move the support portion 32*c* along the radial direction of the sleeve 21. Accordingly, in accordance with the center vent tube aligning mechanism 30 of the present embodiment, it is possible to prevent deformation or dislocation of the sleeve 21 more reliably.

In the center vent tube aligning mechanism 30 of the present embodiment, the nut 31 is provided as a different body from the annular portion 32*a*, the connection portions 32*b*, and the support portions 32*c*. Accordingly, it is possible to simplify the shapes of components and to increase the yield ratio of each component.

The preferred embodiments of the present disclosure have been described above with reference to the accompanying drawings. However, the present disclosure is not limited to the embodiments described above. The shapes, the combination, or the like of the respective constituent members shown in the embodiments described above is one example and various changes can be made based on design requirements or the like within a scope of the present disclosure.

For example, in the first embodiment, a configuration in which two center vent tube aligning mechanisms 13 are provided along the axial direction of the center vent tube 12 is described. However, the present disclosure is not limited to this configuration and it is possible to employ a configuration in which one center vent tube aligning mechanism 13 is provided or three or more center vent tube aligning mechanisms 13 are provided. Such configurations may also be employed in the second embodiment and the third embodiment.

In the first embodiment, a configuration in which four support portions 13*g* are provided is described. However, the present disclosure is not limited to this configuration but the number of the support portions 13*g* can be changed. This applies to the second embodiment and the third embodiment as well.

Here, as shown in FIG. 1, a center vent tube support device 101 is a device which includes a plurality of center vent tube aligning mechanisms 13 and movably retains the center vent tube 12 and aligns the center vent tube 12. In the example shown in FIG. 1, although the center vent tube support device 101 includes two center vent tube aligning mechanism 13, the number of the center vent tube aligning mechanism 13 that the center vent tube support device 101 includes may be one or three or more.

INDUSTRIAL APPLICABILITY

In accordance with the present disclosure, since it is possible to prevent balance of the retention forces of the sleeve from collapsing, it is possible to prevent deformation or dislocation of the sleeve.

What is claimed is:

1. A center vent tube aligning mechanism which aligns a center vent tube inserted into a hollow shaft comprising:

an annular portion which is coaxially provided with the center vent tube in an outer side of the center vent tube in a radial direction thereof;

a flexible portion which protrudes in a direction along an axis of the center vent tube from the annular portion;

an abutting portion which is connected to the flexible portion and which abuts an inner circumferential surface of the shaft;

a cylindrical sleeve which surrounds the center vent tube from the outer side in the radial direction of the center vent tube and which is supported by a reaction force that the abutting portion receives from the inner circumferential surface of the shaft; and a spacer ring which is provided to abut an inner circumferential surface of the cylindrical sleeve and an outer circumferential surface of the center vent tube.

2. The center vent tube aligning mechanism according to claim 1, wherein a plurality of the flexible portions and a plurality of the abutting portions are discretely provided along a circumferential direction of the sleeve.

3. The center vent tube aligning mechanism according to claim 1, further comprising:

an integrated member which integrates together the sleeve with a thread groove on an outer circumferential surface thereof, the annular portion, the flexible portion, and the abutting portion provided such that a gap is provided between the sleeve and the abutting portion, and a nut which is screwed onto the thread groove and located between the sleeve and the abutting portion and has a tapered surface on an outer circumferential surface thereof, and which abuts the abutting portion.

4. The center vent tube aligning mechanism according to claim 1, further comprising:

an integrated member, which integrates together a nut which is screwed together with the thread groove, the annular portion, the flexible portion, and the abutting portion which abuts the tapered surface of the sleeve, wherein the sleeve is provided with a thread groove and a tapered surface on an outer circumferential surface of the sleeve.

5. The center vent tube aligning mechanism according to claim 1, further comprising:

an integrated member which integrates together the annular portion, the flexible portion, and the abutting portion which abuts the tapered surface of the sleeve, and a nut which screws onto the thread groove and fastens together the integrated member and the sleeve, wherein the sleeve is provided with a thread groove and a tapered surface on an outer circumferential surface of the sleeve.

6. The center vent tube aligning mechanism according to claim 3, wherein the integrated member is set such that a maximum dimension thereof in a direction along a horizontal axis which passes a center of the sleeve and is along a radial direction of the sleeve is smaller than a maximum dimension thereof in a direction along a vertical axis which is orthogonal to the horizontal axis.

7. A center vent tube support device which includes a plurality of the center vent tube aligning mechanisms according to claim 1, the plurality of the center vent tube aligning mechanisms being distant from each other in the direction along the axis of the center vent tube.

8. The center vent tube aligning mechanism according to claim 1, wherein the spacer ring is slidable with respect to the cylindrical sleeve.

* * * * *